United States Patent [19]

Shirai et al.

[11] Patent Number: 4,833,365

[45] Date of Patent: May 23, 1989

[54] ELECTRON GUN STRUCTURE FOR CONVERGING ELECTRON BEAMS

[75] Inventors: Shoji Shirai, Koganei; Hidemasa Komoro, Chousei; Yoshiaki Takahashi, Chiba; Masakazu Fukushima, Nishitama; Kazuo Majima, Mobara, all of Japan

[73] Assignees: Hitachi, Ltd., Tokyo; Hitachi Device Engineering Co., Ltd., Chiba, both of Japan

[21] Appl. No.: 13,903

[22] Filed: Feb. 12, 1987

[30] Foreign Application Priority Data

Feb. 19, 1986 [JP] Japan ..... 61-32974
Feb. 19, 1986 [JP] Japan ..... 61-32961

[51] Int. Cl.[4] ..... H01J 29/54; H01J 29/62
[52] U.S. Cl. ..... 313/414; 313/412
[58] Field of Search ..... 313/409, 412, 414, 425

[56] References Cited

U.S. PATENT DOCUMENTS 4,334,169 6/1982 Takenaka et al. ..... 313/414

FOREIGN PATENT DOCUMENTS 63750 4/1982 Japan ..... 313/414

*Primary Examiner*—David K. Moore
*Assistant Examiner*—K. Wieder
*Attorney, Agent, or Firm*—Antonelli, Terry & Wands

[57] ABSTRACT

An electron gun for a color picture tube consists of a triode that generates a plurality of electron beams and a main lens which focuses and converges the electron beams. The main lens can be divided into two types, i.e., a pair of bi-potential focusing electron lenses and a combination of the bi-potential focusing electron lens and a uni-potential focusing electron lens. The electrodes constituting the main lens have apertures for permitting the transmission of a plurality of electron beams. The center axes of apertures are deviated toward the center axis of the embodiment of electron gun away from the axes of initial paths of the electron beams emitted from the triode.

15 Claims, 9 Drawing Sheets

ELECTRON GUN STRUCTURE FOR CONVERGING ELECTRON BEAMS

BACKGROUND OF THE INVENTION

1. Field of the Invention

The present invention relates to an electrode which constitutes a main lens of an electron gun for a color picture tube.

2. Description of the Prior Art

FIG. 1 is a plan view of a color picture tube equipped with an electron gun of a conventional structure. A phosphor screen 3 on which phosphors of three colors are alternatingly applied is supported on the inner wall of a face plate 2 of a glass envelope 1. A triode which is an electron source is constituted by cathodes 6, 7, 8 and a first electrode G1 and a second electrode G2. Center axes 17, 18 and 19 of the cathodes 6, 7 and 8 are, respectively, in agreement with the center axes of apertures that correspond to cathodes of the first and second electrodes G1 and G2, and of the third and fourth electrodes G3 and G4, and of a shield cup 15, the third and fourth electrodes G3, G4 and the shield cup 15 constituting a main lens. The center axes 17, 18 and 19 are arranged on a common plane nearly in parallel with each other. The center axis 18 is also a center axis of the embodiment of electron gun. Cylindrical portions 117, 118, 119, 127, 128 and 129 are protruded from the opposing apertures of the third and fourth electrodes G3 and G4, the cylindrical portions being directed toward the interior of the electrodes. The cylindrical portions 117, 118, 119, 127, 128 and 129 play the role of shielding plates so that the electric field will uniformly infiltrate into the interior of the electrodes. Among these cylindrical portions 117, 118, 119, 127, 128 and 129 that work as shielding plates, the cylindrical portions 117, 119, 127 and 129 arranged on both sides have ends that are tilted at a predetermined angle with respect to the center axes 17 and 19.

Three electron beams emitted from the cathodes 6, 7 and 8 are incident upon the main lens along the center axes 17, 18 and 19. The center axes 17, 18 and 19 are referred to as initial paths of the electron beams. A focus voltage of about 5 to 9 KV is applied to the third electrode G3, and to the fourth electrode G4 is applied a voltage of a high as about 20 to 30 KV that is also commonly applied to the shield cup 15 and to a conductive coating 5 formed inside the glass envelope 1. Since the cylindrical portions 118 and 128 are symmetrically formed along the center axis 18, the main lens is symmetrical along the axis to focus the electron beam (central beam) that passes along the center axis 18 as a path. Accordingly, the center beam proceeds straight along the center axis 18. On the other hand, the main lens formed along the center axes 17 and 19 of the outer side has ends that are tilted at the cylindrical portions 117, 119, 127 and 129, and has the action to focus the electron beams as well as the action to deflect the electron beams as has been disclosed in Japanese Patent Laid-Open No. 63750/1982 (U.S. Ser. No. 307,572). Thus, the outer electron beams (electron beams that pass along the center axes 17, 19 as paths) incident upon the main lens along the center axes 17 and 19 of the outer sides, are converged by the main lens and receive the convergence power in the direction of center beam.

As described above, the three electron beams are focused on a shadow mask 4 and are converged so as to be superposed upon one another. The operation for converging the electron beams is called convergence and is particularly called static convergence (hereinafter abbreviated as STC) when the convergence takes place at the center of the screen. The electron beams are chromatically sorted by the shadow mask 4, and only those components that excite the phosphors of the corresponding colors are allowed to pass through apertures of the shadow mask to reach the phosphor screen. In order to scan the electron beam on the phosphor screen, furthermore, an external magnetic deflection yoke 16 is provided to surround the periphery of the glass envelope 1.

However, the apparatus of FIG. 1 has problems as described below. Namely, the outer beams incident upon the main lens along the initial paths 17 and 19 receive the convergence power in the third electrode G3 in the direction of the center axis 18. Therefore, the outer beams pass through portions that lie inside the center axes 17 and 19 of the main lens, whereby comma aberration is generated to form distorted spots on the screen.

FIG. 2 is a plan view of a color picture tube equipped with another electron gun of the conventional structure. What makes the structure of FIG. 2 different from that of FIG. 1 is that the main lens is constituted by a third electrode G32, a fourth electrode G42, a fifth electrode G52, a sixth electrode G62, and a shield cup 15. In FIG. 2, the fifth electrode G52 and the sixth electrode G62 have cylindrical portions 117, 118, 119, 127, 128 and 129 with tilted ends like the third and fourth electrodes G3, G4 of FIG. 1.

The three electron beams emitted from the cathodes 6, 7 and 8 are incident upon the main lens along the center axes 17, 18 and 19. In the example of FIG. 2, the main lens consists of a combination of two electron lenses, i.e., a so-called uni-potential focusing electron lens (UPF lens) constituted by the third electrode G32, fourth electrode G42 and fifth electrode G52, and a so-called bi-potential focusing electron lens (BPF lens) constituted by the fifth electrode G52 and sixth electrode G62. The main lens having the above-mentioned structure is called multi-step-focusing lens. The sixth electrode G62 assumes the same potential as the shield cup 15 and the conductive coating 5 formed inside the glass envelope 1, and is served with a high voltage of about 20 to 30 KV. The third electrode G32 and the fifth electrode G52 are served with a focus voltage of about 5 to 9 KV. There can be considered a case where a high potential common to the sixth electrode G62 is applied to the fourth electrode G42, and another case where the fourth electrode G42 is served with a low potential of about 400 to 1000 volts which is nearly equal to that of the second electrode G2.

The beam incident upon the main lens is focused by the above-mentioned two lenses (UPF lens and BPF lens). The main lens is symmetrically formed along the axis for the beam (central beam) that is incident along the center axis 18. Therefore, the center beam is focused by the main lens and proceeds straight through a trajectory along the center axis 18. On the other hand, of the electron lenses constituting the main lens formed along the center axes 17, 19 of the outer sides, the BPF lens formed by the fifth electrode G52 and the sixth electrode G62 has cylindrical portions that are tilted, and is capable of focusing the electron beam as well as deflecting it like the electron lens of FIG. 1, and makes it easy to establish the STC.

With the devices shown in FIGS. 1 and 2, the amount of deflecting the outer beams increases with the increase in the tilting angle at the ends of the cylindrical portions of the electrodes. To increase the tilting angle, a maximum value in the length of the cylindrical portions must be increased and a minimum value must be decreased. From the standpoint of manufacturing the electrodes, however, the upper limit of maximum value is about 50% of the inner diameter of the cylindrical portion and the lower limit of minimum value is about 2.5 times the thickness of the electrode. In fabricating the electrodes, therefore, if use is made of metal plates having nearly the same thickness, the maximum value decreases with the decrease in the diameter of the main lens. On the other hand, since the minimum value remains constant, the tilting angle decreases at the ends of the cylindrical portions. This decreases the amount of deflecting the outer beams, and it becomes difficult to establish the STC.

In order to solve such a problem according to the multi-step-focusing lens of FIG. 2, not only BPF lens but also the UPF lens, which consists of the third, fourth and fifth electrodes G32, G42, G52, is formed asymmetrically along the axis, in order to give deflection power to the electron beam and to compensate the lack of the amount of deflection.

FIG. 3 shows an example in which beam deflection means of an asymmetrical structure shown in U.S. Pat. No. 3,772,554 and U.S. Pat. No. 3,873,879 is applied to the UPF lens, in order to increase the amount of deflecting the beam. That is, between a pair of third and fourth electrodes G32 and G42, the center axis of the aperture of the fourth electrode G42 located on the side of the phosphor screen is slightly deviated outwardly relative to the center axis of the aperture of the third electrode G32, so that the outer beam is deflected toward the direction of center beam. Here, among the neighboring electrode apertures, the apertures on the side of the phosphor screen have diameters that are not smaller than the diameters of the apertures of the other side, so that the electrode apertures can all be secured with a cylindrical jig that is inserted from the side of the sixth electrode G62. The fourth electrode G42 is serviced with a high voltage Vo which is commonly applied to the sixth electrode G62, and the third and fifth electrodes G32 and G52 are served with a focus voltage Vf which is lower than the voltage Vo.

Even with the electron gun of the above-mentioned structure, however, the problem arises as described below like that of FIG. 1. That is, the outer beam 20 shown in FIG. 3 is deflected toward the center axis 18, and passes through a portion that is greatly deviated from the center axis of the aperture of the fourth electrode G42 of which the center axis is outwardly deviated. Therefore, the outer beam 20 receives different convergence power depending upon the portion on the side of the center axis 18 and the portion on the side of the center axis 17 to form a spot of a distorted shape on the phosphor screen.

FIG. 4 schematically illustrates the shapes of spots of the beams on the color picture tube. Spot shapes 31 and 32 of outer beams are shown on both sides of a spot 30 of the center beam. Hatched areas represent high brightness portions 301, 311, 321 that are called cores, and the peripheries thereof represent low brightness portions 302, 313, 322 that are called halos. In the spots 31 and 32, in particular, the halos spread in the lateral directions to deteriorate the vertical resolution of the color picture tube.

Such a problem also takes place even with the main lens of the structure in which a potential nearly equal to that of the second electrode G2 is applied to the fourth electrode G42. According to the method of FIG. 3, in this case, the center axis of aperture of the fifth electrode G52 on the side of the fourth electrode G42 must be deviated outwardly compared with the aperture of the outer side of the fourth electrode G42. Even with this structure, however, the outer beams pass through a portion inside the center axis of aperture of the fifth electrode G52 on the side of the fourth electrode G42, and the spot shapes on the screen are distorted like those shown in FIG. 4.

The method of deflecting the electron beam in two steps is employed in order to prevent the amount of deflecting the beam from varying relative to the focus voltage Vf when the potential of the fourth electrode G42 is lower than the potential of the third and fifth electrodes G32 and G52 as has been taught in Japanese Patent Laid-Open No. 53853/1980. In this case, the electron beam is often deflected by deviating the center axis of aperture even between the fifth electrode G52 and the sixth electrode G62. Even in this case, the spots of outer beams are distorted as shown in FIG. 4, as a matter of course.

SUMMARY OF THE INVENTION

The object of the present invention is to provide an electron gun for a color picture tube equipped with electron beam deflection means which makes it possible to decrease the distortion of spots of outer beams on a phosphor screen.

Another object of the present invention is to provide an electron gun for a color picture tube which is capable of increasing the convergence power for the electron beams to sufficiently maintain the STC.

In the conventional devices, spot shapes of the outer beams are distorted on the phosphor- screen because of the reasons described below. Namely, as the electron beam passes between the electrodes that are asymmetrically constructed to deflect the beam toward the central direction, some portion of the beam passes through portions that are greatly deviated from the center axis of the apertures between the opposing electrodes. The electron beam that passes being greatly deviated from the center axis of the aperture develops unbalance in the focusing power, so that the beam spot is distorted.

An electron gun for a color picture tube according to the present invention comprises:

first electrode means (6, 7, 8, G1, G2) which generates a plurality of electron beams that are oriented along the axes of initial paths which are in parallel with each other; and second electrode means (G3, G4, G5, G6) which focuses said plurality of electron beams onto a phosphor screen, which converges said plurality of electron beams onto predetermined positions on said phosphor screen, and which constitutes a main lens for each of the paths of said plurality of electron beams;

said second electrode means being comprised of at least a pair of electrodes that are provided maintaining a distance along the axes of said initial paths;

the opposing surfaces of said pair of electrodes having apertures to permit the passage of said plurality of electron beams, the apertures being provided for each of the paths of said plurality of electron beams; and the center axis of said aperture of at least the electrode on the side of said phosphor screen between said pair of electrodes being deviated toward the center axis of the embodiment of electron gun away from the axes of said initial paths.

According to an electron gun for a color picture tube of the present invention, the electron beam that passes through the electron lens is incident from the outer side of the electron lens. In this case, the electron beam is deflected and passes through the center point of the electron lens. This helps decrease the distortion of the spot of the electron beam. At the same time, the convergence power of the electron lens establishes the STC.

DETAILED DESCRIPTION OF THE PREFERRED EMBODIMENTS

An embodiment of the present invention will now be described in detail in conjunction with the accompanying drawings.

Figure 1:
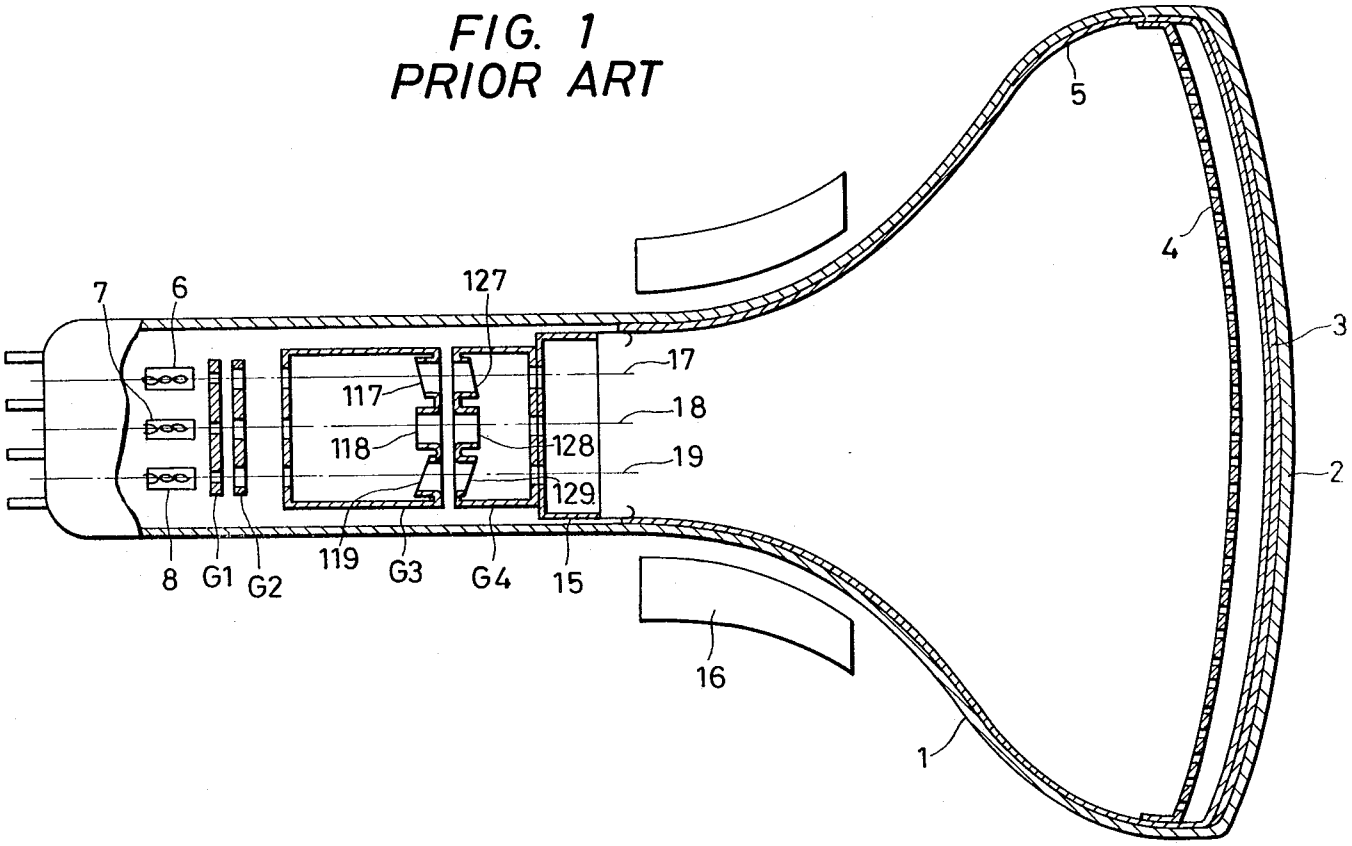
FIG. 1 PRIOR ART
FIG. 1 is a section view of a color picture tube equipped with an electron gun of a conventional structure.
Figure 5:
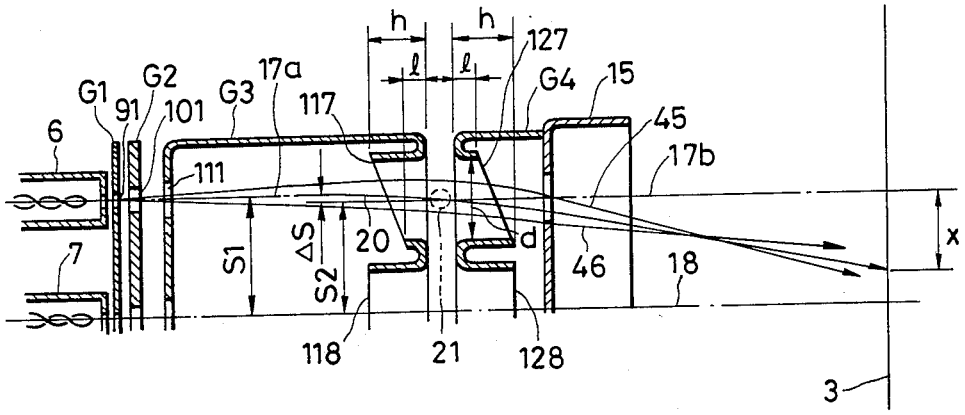
FIG. 5 is a section view illustrating a portion of an electron gun according to an embodiment of the present invention.

FIG. 5 is a diagram illustrating an embodiment in which the present invention is adapted to the electron gun of FIG. 1.

A center axis 17*a* of a cathode 6, of an outer aperture 91 of the first electrode G1, of an outer aperture 101 of the second electrode G2 and of an outer aperture 111 of the third electrode G3 on the side of the second electrode G2, is outwardly deviated relative to a center axis 18 as compared with a center axis 17*b* of a main lens which is constituted by the third and fourth electrodes G3 and G4. The ends of cylindrical portions 117 and 127 are tilted relative to the center axis 17*b*, , the cylindrical portions 117 and 127 being protruded from the outer apertures of the third and fourth electrodes G3 and G4 toward the interiors thereof. The electron beams 45, 46 incident along the initial path 17*a* are deflected by the tilted electric field established by the inclination of the ends of the cylindrical portions 117 and 127, whereby the center trajectory 20 of the electron beams 45, 46 passes near the center 21 of the main lens. This decreases the distortion of the spots of the beams. Further, the electron beams 45, 46 pass through the portions deviated from the center axis 17*b* of the main lens to receive a focusing force, and hence receive a strong convergence power in the direction of center beam.

Concrete dimensions of the embodiment are as described below.

Distance between the center axes of apertures of the main lens; $s_2=4.75$ mm

Aperture diameter of the main lens; $d=3.9$ mm

Relying upon the above dimensions, a relation will now be described between the distortion of beam spot and the deviation ΔS of the center axes 17*a*, 17*b*.

Analyzed below are the center trajectory 20 of the electron beam and electron beams having two trajectories 45, 46 that are incident maintaining a predetermined angle (±0.5°) with respect to the center trajectory. A focus voltage Vf at which the trajectory 45 incident at a positive angle is in agreement with the center trajectory 20 on the phosphor screen 3, is denoted by Vfh1, and a focus voltage Vf at which the trajectory 46 incident at a negative angle is in agreement with the center trajectory 20 on the phosphor screen 3, is denoted by Vfh2. When Vfh1 is in agreement with Vfh2, the electron beam receives the same focusing force on both sides of the center trajectory, and there is no distortion in the spot shape on the phosphor screen. If there is a great difference between these voltages, however, the distortion develops greatly.

Figure 6:
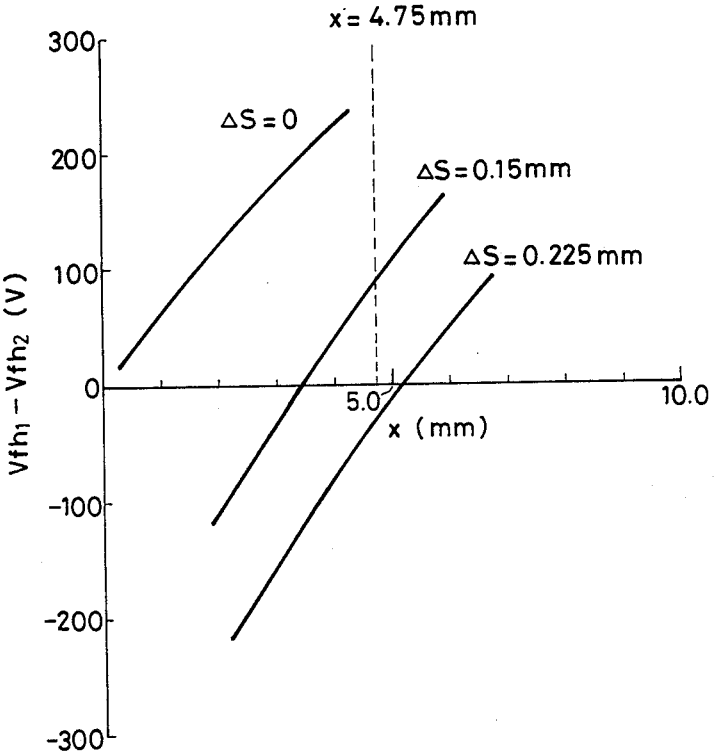
FIGS. 6 and 7 are diagrams illustrating the characteristics of the electron gun of FIG. 5.

FIG. 6 shows a relationship between the beam deflection amount x and the spot distortion represented by the difference between Vfh1 and Vfh2, with the amount of ΔS as a parameter. The amount of beam deflection is represented by a discrepancy x of the center trajectory 20 of the beam shown in FIG. 5 from the center axis 17*b* on the phosphor screen 3. The discrepancy x is a value of when Vf is Vfh2. As will be comprehended from FIG. 6, the amount of beam deflection is increased when ΔS is zero, i.e., the amount of beam deflection is increased by increasing the inclination of the ends of the cylindrical portions 117, 127 in the conventional art of FIG. 1. Accompanying the increase in the amount of beam deflection, however, discrepancy increases between Vfh1 and Vfh2, and the beam spot is distorted conspicuously. According to the embodiment of the present invention, on the other hand, ΔS is selected to be 0.15 mm and 0.225 mm, so that the value Vfh1−Vfh2 is maintained small and the distortion of the beams spot is sufficiently restrained even when the amount x of beam deflection is equal to $s_2=4.75$, i.e., even when the conditions of STC are satisfied.

Figure 7:
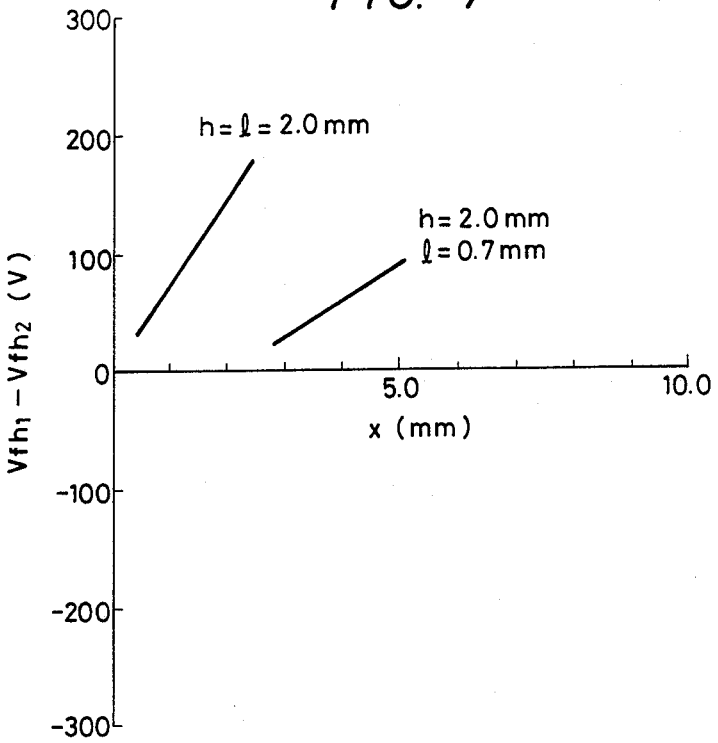

In the embodiment of FIG. 5, the tilted electric field does not generate when the inclination is zero at the ends of the cylindrical portions 117, 127 of the third and fourth electrodes G3, G4, i.e., when a maximum value h of the height of the cylinder is equal to a minimum value l. The STC, however, can be established by increasing the amount of ΔS. However, a large amount of ΔS results in the increase in the distortion of beam spot. FIG. 7 shows a relationship between the amount x of beam deflection and the distortion of spot represented by the difference between Vfh1 and Vfh2, with the above-mentioned values h and l as parameters. It will be understood from FIG. 7 that when h and l are equal to each other, the value Vfh1−Vfh2 increases when the amount of ΔS is increased and the amount x of beam deflection is increased. On the other hand, it will be comprehended that when a difference of 1.3 mm is maintained between h and l and the ends of the cylindrical portions 117 and 127 are tilted, the value Vfh1−Vfh2 decreases and the distortion of spot is sufficiently suppressed.

Figure 8:
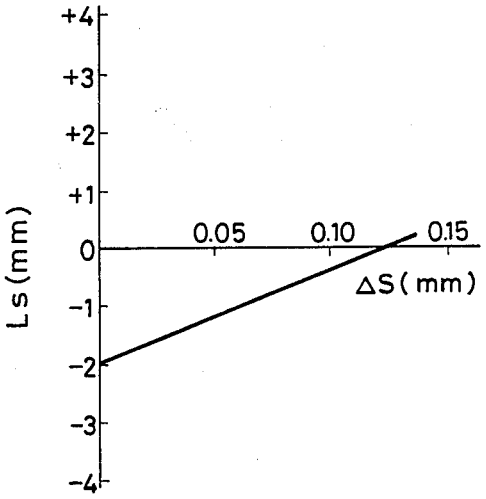
FIG. 8 is a diagram showing a relationship between ΔS and the distance Ls between beam spots in the electron gun of FIG. 5.

FIG. 8 is a diagram illustrating the measured results of a relation between the amount of ΔS and the distance Ls between the outer beam spots on a shadow mask. As the distance Ls becomes zero, it means that the three electron beams are converged on the phosphor screen and the STC is established. In FIG. 8, a maximum value h is 2.0 mm and a minimum value l is 0.7 mm, that represents the shape of the tilted ends of the cylindrical portions 17, 119, 127 and 129 of the third and fourth electrodes G3, G4. The above value h is the greatest value and the value l is the smallest value that are obtainable with the current technology. Therefore, it is difficult to further steepen the shape of the tilted ends.

Further, the focus voltage is set to be about 28% of the accelerating voltage. To increase the resolution by decreasing the diameter of beam spots on the phosphor screen 3, in general, the focus voltage should be great to some extent. Being restricted by the breakdown voltage characteristics, however, it is not allowed to increase the focus voltage so highly. As a compromising point between the two, therefore, the focus voltage is set to be about 28% of the accelerating voltage.

When the distance Ls is of a negative value in FIG. 8, the convergence power is not sufficient for the electron beams and the beams are not converged on the shadow mask 4. When the distance Ls is of a positive value, the electron beams are converged prior to reaching the shadow mask 4. Analyzed results of FIG. 6 and FIG. 7 and measured values of FIG. 8 are those of a color picture tube having a screen diagonal size of 14 inches and a maximum beam deflection angle of 90 degrees. In this case, the distance is 250 mm between the shadow mask and the main lens.

It will be understood from FIG. 8 that if the amount of ΔS is selected to be about 0.125 mm, the distance between the outer beam spot becomes zero and the STC is established. It will, however, be recognized that for the STC the amount of ΔS is not needed to be exactly zero. In a practical color picture tube, in general, the STC is finally adjusted by the external magnet, and the above-mentioned distance needs not be completely brought into zero but may be from −0.5 to −1.0 mm. Therefore, the amount of ΔS should suitably be from 0.05 to 0.10 mm.

Figure 2:
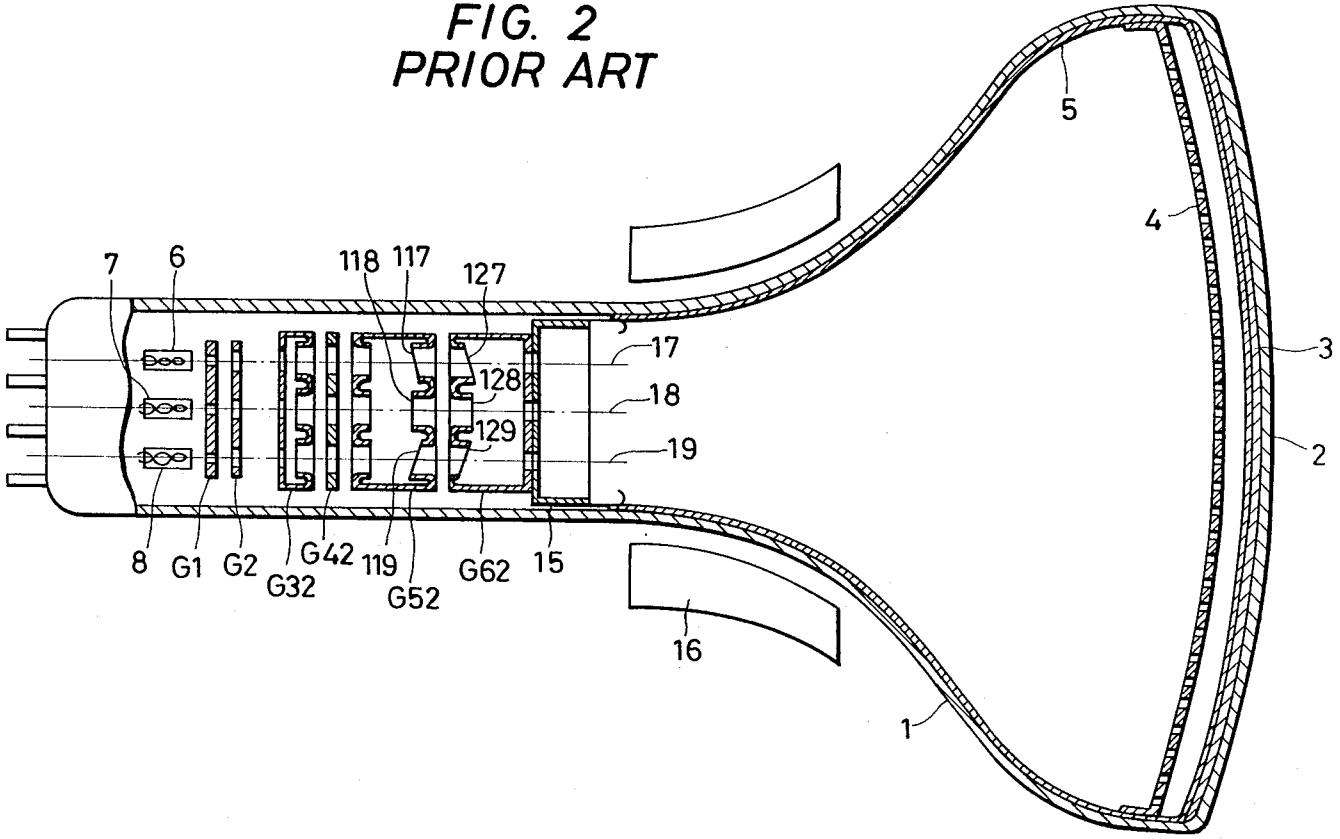
FIG. 2 PRIOR ART
FIG. 2 is a section view of a color picture tube equipped with a multi-step-focusing electron gun of a conventional structure.

In the following embodiment shown in FIG. 9, the present invention is adapted to a multi-step-focusing electron gun of FIG. 2. Unlike the conventional example of FIG. 2, among the apertures of the fifth electrode G52 on the side of the fourth electrode G42, the center axes 17*c* of apertures of both sides are inwardly deviated. Therefore, the electron beam is also deflected even through the UPF lens. Even when the amount of deflection is not sufficient through the BPF lens, therefore, the three electron beams can be converged to establish the STC. On the side of the phosphor screen in this case, the center axis 17*c* of the aperture is deviated toward the direction in which the beam is deflected, i.e., deviated inwardly, and whereby the electron beam passes near the center axis 17*c* of the aperture of the fifth electrode G52 on the side of the fourth electrode G42 to suppress the distortion.

Figure 10:
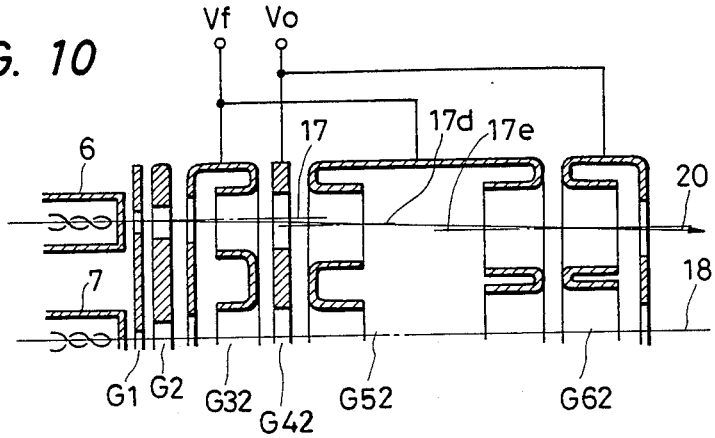

FIG. 10 illustrates a further embodiment according to the present invention where a focus voltage Vf is commonly applied to the third electrode G32 and to the fifth electrode G52, and a high voltage Vo is commonly applied to the fourth electrode G42 and to the sixth electrode G62. The center axis 17*d* of the aperture of the fifth electrode G52 on the side of the fourth electrode G42, and a common center axis 17*e* of the opposing apertures of the fifth electrode G52 and of the sixth electrode G62, are gradually deviated toward the inside compared with the center axis 17 of the triode and of the third and fourth electrodes G32, G42. Therefore, the center trajectory 20 of the side beam passes near the centers of apertures of all electrodes while being deflected toward the direction of center beam. Therefore, though the beam is deflected, distortion of spots is reduced on the phosphor screen.

Figure 11:
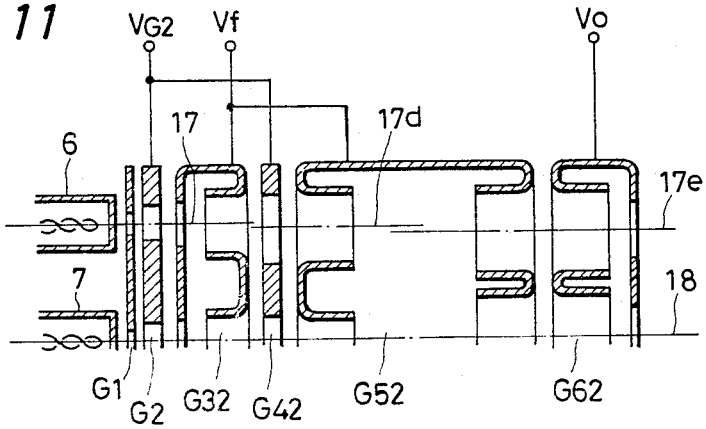

FIG. 11 illustrates a still further embodiment of the present invention wherein a focus voltage Vf is commonly applied to the third electrode G32 and to the fifth electrode G52, a low voltage VG2 is commonly applied to the fourth electrode G42 and to the second electrode G2, and a high voltage Vo is applied to the sixth electrode G62. The spots are deformed little since the center axis 17*d* of the opposing apertures of the fourth and fifth electrodes G42 and G52, and the center axis 17*e* of the opposing apertures of the fifth and sixth electrodes G52 and G62, are gradually deviated inwardly compared with the center axis 17 of the triode and of the apertures of third electrode G32.

Figure 12:
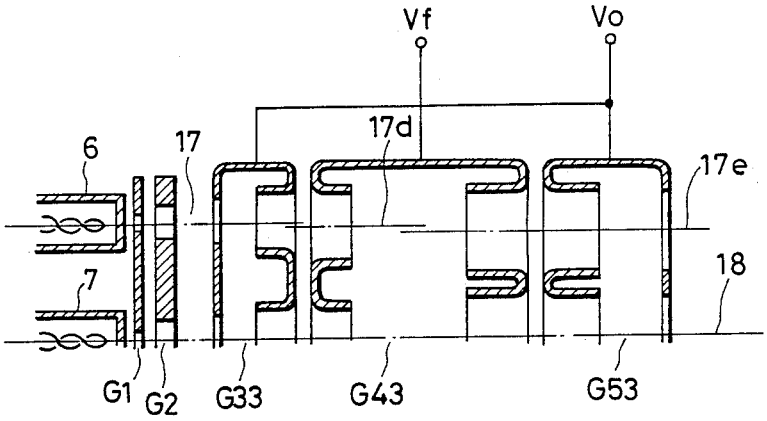

FIG. 12 illustrates an embodiment of the present invention wherein a high voltage Vo is commonly applied to the third electrode G33 and to the fifth electrode G53, and a focus voltage Vf is applied to the fourth electrode G43. A BPF lens is formed between the third electrode G33 and the fourth electrode G43, and between the fourth electrode G43 and the fifth electrode G53, respectively. The center axis 17*d* of the fourth electrode G43 of the side of the third electrode G33, and the center axis 17*e* of the opposing apertures of the fourth electrode G43 and the fifth electrode G53, are gradually deviated toward the direction of center beam (center axis 18), compared with the center axis 17 of the triode and of aperture of the third electrode G33. Therefore, the outer beams deflected toward the direction of center beam always pass near the center axis of apertures of all electrodes, so that the spots are deformed little.

Figure 13A:
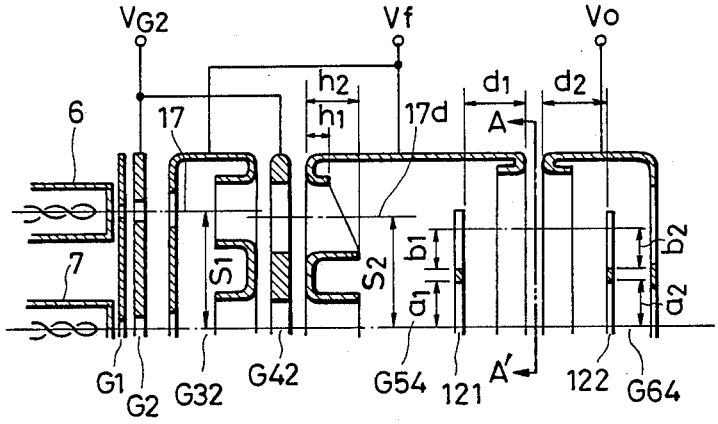
Figure 13B:
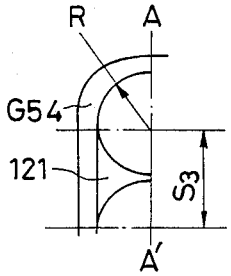
FIG. 13B is a side view along the line A—A' of FIG. 13A.

FIG. 13 illustrates an embodiment where the BPF lens constituted by the fifth electrode G52 and the sixth electrode G62 assumes the structure of a non-cylindrical electrons lens as taught in Japanese Patent Laid-Open No. 215640/1984, and is combined with the UPF lens to which is adapted to the present invention and which is constituted by the third, fourth and fifth electrodes G32, G42 and G52. Electrode plates 121, 122 having oval apertures are provided in the fifth electrodes G54 and in the sixth electrodes G64. The center axis 17*d* of apertures of the fourth and fifth electrodes G42 and G54 is inwardly deviated compared with the center axis 17 of the triode and of the aperture of the third electrode G32. Further, of the cylindrical portions of the fifth electrode G54 that are protruded from the apertures of the side of the fourth electrode G42 into the interior of the fifth electrode G54, the cylindrical portion of the outer side is tilted relative to the center axis 17*d*. This is to reinforce the deflection power since the deflection of beam based upon the deviation of center axes 17 and 17*d* only is not sufficient to deflect the beams. When the center axis 17*d* is sufficiently deviated from the center axis 17 to establish the STC, ordinary cylinders may be employed without the need of inclining the ends of the cylindrical portions.

Described below are representative dimensions of the embodiment of FIG. 13.

Distance between the center axes of apertures of the triode and of the third electrode G32; $S_1=5.78$ mm Distance between the center axes of apertures of the fourth electrode G42 and of the fifth electrode G54; $S_2=5.70$ mm Heights of cylindrical portions of the fifth electrode G54;

$h_1=0.7$ mm $h_2=2.0$ mm

Short radii of central oval apertures of the electrode plates 121, 122;

$a_1=2.2$ mm $a_2=2.5$ mm

Short radii of outer ellipses of the electrode plates 121, 122;

$b_1=2.1$ mm $b_2=2.5$ mm

Retreated amounts of the electrode plates 121, 122;

$d_2=4.0$ mm $d_2=4.0$ mm

Radius of outer portions of the apertures of the fifth and sixth electrodes G54, G64; $R=4.0$ mm Here, if $h_1=h_2$ so that the end of the cylindrical portion of the fifth electrode G54 is not tilted, the size $S_1$ must be increased to 5.8 mm to establish the STC.

Figure 3:
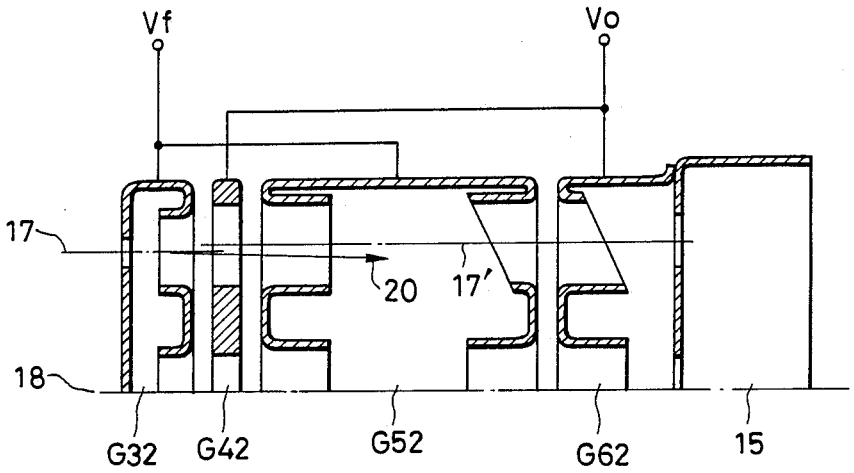
FIG. 3 PRIOR ART
FIG. 3 is a section view illustrating a portion of the multi-step-focusing electron gun of the conventional structure.
Figure 4:
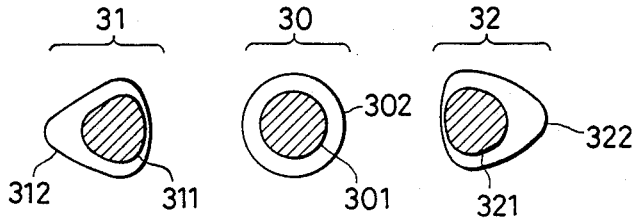
FIG. 4 is a diagram which schematically illustrates the shapes of spots of electron beams on a phosphor screen of the color picture tube.
Figure 9:
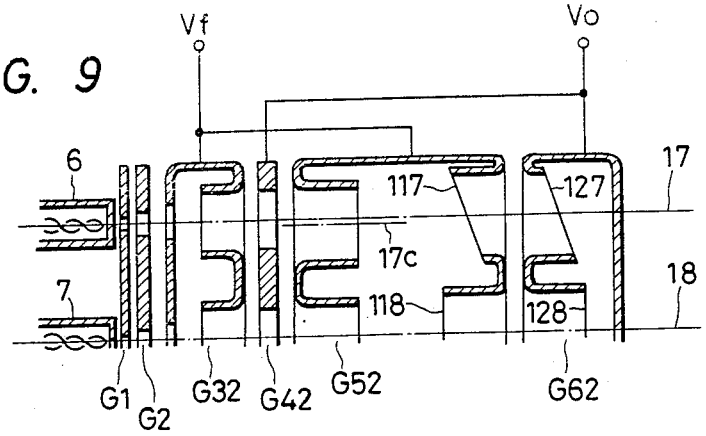
FIGS. 9, 10, 11, 12 and 13A are section views illustrating portions of the embodiments where the invention is adapted to the multi-step-focusing electron gun.
Figure 14:
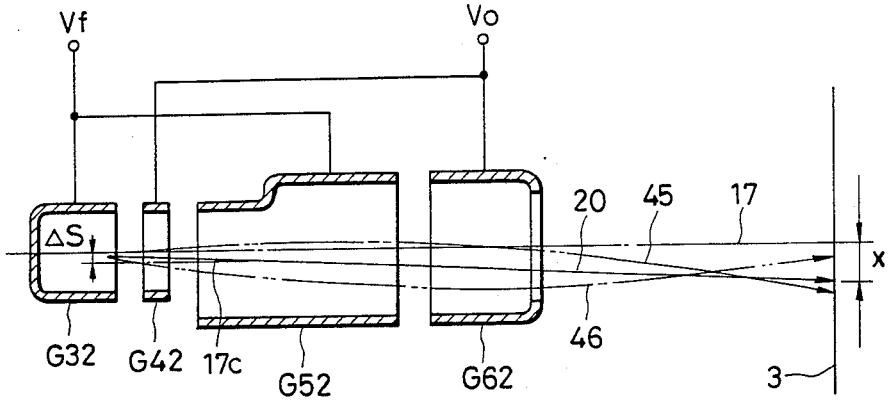
FIG. 14 is a diagram which schematically illustrates cylindrical electrodes in compliance with the embodiment of FIG. 5.
Figure 15:
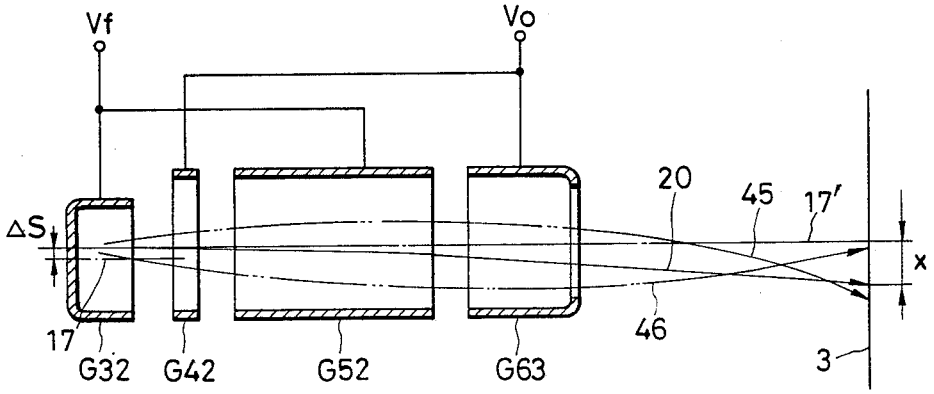
FIG. 15 is a diagram which schematically illustrates cylindrical electrodes in compliance with the conventional example of FIG. 3.

To confirm the effects of the embodiment, the embodiment of FIG. 9 of the present invention and the conventional example of FIG. 3 are analyzed relying upon an electron beam analytical program to compare the results. Here, to simplify the explanation, the following description deals with a main lens constituted by cylindrical electrodes as shown in FIGS. 14 and 15. FIG. 14 corresponds to FIG. 9, and FIG. 15 corresponds to FIG. 3, respectively. The UPF lens formed by the third electrode G32, fourth electrode G42 and fifth electrode G52, is provided with beam deflection means. In the embodiment of FIG. 14, the center axis 17*c* of aperture of the fifth electrode G52 on the side of the fourth electrode G42 is inwardly deviated, the fifth electrode G52 being served with a focus voltage. In the conventional example of FIG. 15, the center axis 17′ of aperture of the fourth electrode G42 served with a high voltage is outwardly deviated compared with the center axis 17 of aperture of the opposing third electrode G32. In either case, among the neighboring apertures, the apertures on the side of the sixth electrode have diameters that are not smaller than the diameters of apertures of the other side, such that fixing jigs can be inserted from the side of the sixth electrode G62 at the time when the electrode is being assembled.

Analyzed below are electron beams having a center trajectory 20 and two trajectories 45, 46 that are incident maintaining a predetermined angle (±0.5°) with respect to the center trajectory. A focus voltage Vf is denoted by Vfh1 at which the trajectory 45 incident at a positive angle is in agreement with a center trajectory 17 on the phosphor screen 3, and a focus voltage Vf is denoted by Vfh2 at which the trajectory 46 incident at a negative angle is in agreement with the center trajectory 20 on the phosphor screen 3. As the values Vfh1 and Vfh2 are brought into agreement with each other, the electron beams receive the same focusing power on both sides of the center trajectory, and the spot shapes are not distorted on the phosphor screen. Conversely, if the difference of voltage increases, the distortion increases.

Figure 16:
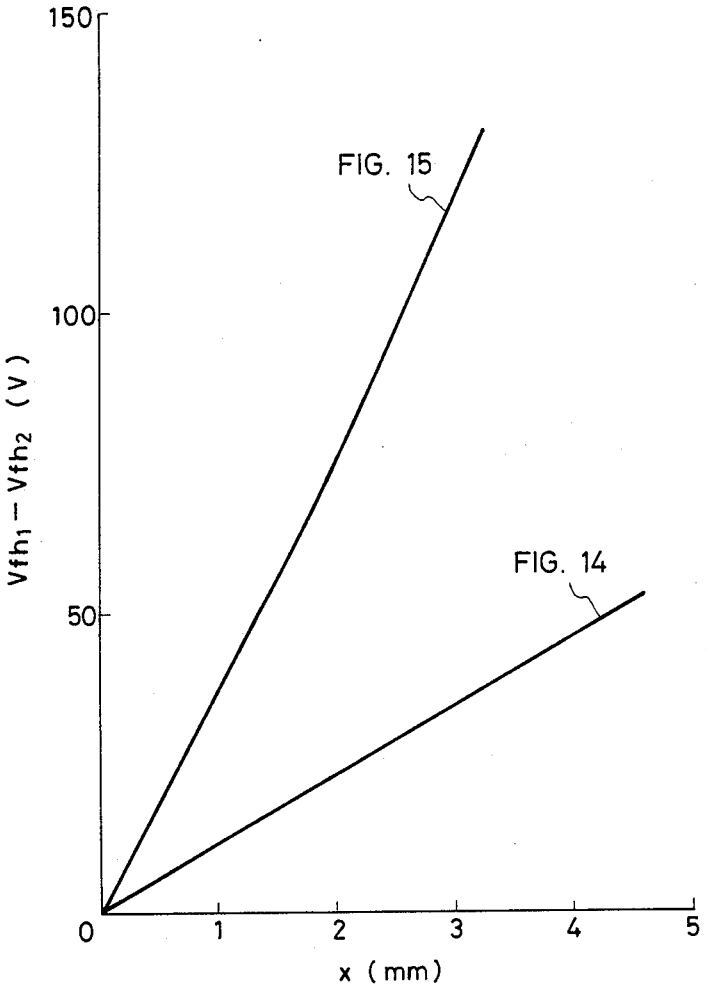
FIG. 16 is a diagram which compares the characteristics of FIGS. 14 and 15.

FIG. 16 shows a relationship between the amount x of beam deflection and the distortion of spots represented by the difference between Vfh1 and Vfh2. The amount of beam deflection is represented by the discrepancy x of the center trajectory 20 of beam from the center axes 17, 17′ on the phosphor screen 3 shown in FIGS. 14 and 15. The value of discrepancy x is that of when the focus voltage Vf has assumed Vfh2. As the eccentricity ΔS of the center axis of the aperture increase to increase the amount x of beam deflection, discrepancy increases between Vfh1 and Vfh2, and the distortion of beam spots appears conspicuously. According to the embodiments of the present invention, however, the distortion is suppressed compared with that of the conventional structures.

We claim:

1. An electron gun for a color picture tube comprising:

first electrode means which generates a plurality of electron beams that are oriented along the axes of initial paths which are in parallel with each other; and second electrode means which focuses said plurality of electron beams onto a phosphor screen, which converges said plurality of electron beams onto predetermined positions on said phosphor screen, and which constitutes a main lens for each of the paths of said plurality of electron beams;

said second electrode means being comprised of at least a pair of electrodes that are provided maintaining a distance along the axes of said initial paths;

the opposing surfaces of said pair of electrodes having apertures to permit the passage of said plurality of electron beams, the apertures being provided for each of the paths of said plurality of electron beams; and the center axes of outer apertures of at least the electrode on the side of said phosphor screen between said pair of electrodes being deviated toward the center axis of the electron gun away from the axes of said initial paths.

2. An electron gun for a color picture tube according to claim 1, wherein at least one electrode between said pair of electrodes has shielding plates to surround the center axis of the apertures of said electrode, the center axis of said outer apertures not being common to the center axis of said electron gun, and said shielding plates for said outer apertures being asymmetrical relative to the center axis thereof, and the center axes of the outer apertures of said pair of electrodes are common relative to each other, and are deviated toward the center axis of said electron gun away from the axes of said initial paths.

3. An electron gun for a color picture tube according to claim 2, wherein said shielding plates are provided in the opposing directions with the opposing surfaces of said pair of electrodes as a center, and are constituted by cylinders that are provided in concentric with the center axis of said outer apertures, and end surfaces of said cylinders are tilted so that the electron beams are deflected toward the center axis of said electron gun relative to the center axis of said openings.

4. An electron gun for a color picture tube according to claim 1, wherein said second electrode means comprises a third electrode, a fourth electrode, a fifth electrode and a sixth electrode that are successively arranged from said first electrode means toward said phosphor screen, and the center axis of an outer aperture of at least one electrode among said fourth, fifth and sixth electrodes is deviated toward the center axis of said electron gun away from the axes of said initial paths.

5. An electron gun for a color picture tube according to claim 4, wherein a high voltage (20 to 30 kilovolts) is commonly applied to said fourth and sixth electrodes, and a low voltage (5 to 9 kilovolts) is commonly applied to said third and fifth electrodes.

6. An electron gun for a color picture tube according to claim 4, wherein a high voltage (20 to 30 kilovolts) is applied to said sixth electrode, a medium voltage (5 to 9 kilovolts) is commonly applied to said third and fifth electrodes, and a voltage common to a low voltage (400 to 1000 volts) applied to said first electrode means, is applied to said fourth electrode.

7. An electron gun for a color picture tube according to claim 4, wherein said fifth electrode has separate apertures for said fourth and sixth electrodes, and the center axis of the outer aperture of said fifth electrode on the side of said fourth electrode is deviated toward the center axis of said electron gun away from the axes of said initial paths.

8. An electron gun for a color picture tube according to claim 7, wherein the center axis of apertures of said third, fourth and sixth electrodes and the center axis of apertures of said fifth electrode on the side of said sixth electrode, are common to the axis of said initial path, provision is made of cylindrical shielding plates that are directed in the opposite directions with the opposing surfaces of said fifth and sixth electrodes as a center to surround the center axis of outer apertures of said fifth and sixth electrodes that is not common to the center axis of said electron gun, said cylindrical shielding plates being in concentric with the center axis of said outer apertures of said fifth and sixth electrodes, and the ends of the cylinders are so tilted that said electron beam is deflected toward the center axis of said electron gun relative to the center axis of the apertures of said cylinders.

9. An electron gun for a color picture tube according to claim 7, wherein the center axis of said outer aperture of said fifth electrode on the side of said sixth electrode is deviated toward the center axis of the electron gun away from the axes of said initial paths, and the center axis of said outer aperture of said fifth electrode on the side of said sixth electrode is common to the center axis of said outer aperture of said sixth electrode.

10. An electron gun for a color picture tube according to claim 9, wherein the center axis of openings of said third and fourth electrodes is common to the axis of said initial path.

11. An electron gun for a color picture tube according to claim 9, wherein the center axis of an opening of said fourth electrode is common to the center axis of opening of said fifth electrode on the side of said fourth electrode, and the center axis of said aperture of said third electrode is common to the axis of said initial path.

12. An electron gun for a color picture tube according to claim 7, wherein the center axis of said outer aperture of said third electrode is common to the axis of said initial path, the center axis of an opening of said fourth electrode is common to the center axis of opening of said fifth electrode on the side of said fourth electrode, an electrode plate is provided in a portion where said fifth and sixth electrodes are opposed to each other, both ends of the electrode plate having the shape of an ellipse which is partly cut away, and the center axis of the ellipse being more deviated toward the center axis of said electron gun than the center axis of said outer aperture of said fifth electrode on the side of the fourth electrode.

13. An electron gun for a color picture tube according to claim 1, wherein said second electrode means comprises a third electrode, a fourth electrode and a fifth electrode that are successively arranged from said first electrode means toward said phosphor screen, and the center axis of an outer aperture of at least one electrode among said third, fourth and fifth electrodes is deviated toward the center axis of said electron gun away from the axis of said initial path, said third and fifth electrodes are commonly served with a high voltage (20 to 30 kilovolts), and said fourth electrode is served with a medium voltage (5 to 9 kilovolts).

14. An electron gun for a color picture tube comprising:

first electrode means which generates a plurality of electron beams that are oriented along the axes of initial paths which are in parallel with each other; and second electrode means which focuses said plurality of electron beams onto a phosphor screen, which converges said plurality of electron beams onto predetermined positions on said phosphor screen, and which constitutes a main lens for each of the paths of said plurality of electron beams;

said second electrode means including at least a pair of electrodes that are provided maintaining a distance along the axes of said initial paths;

the opposing surfaces of said pair of electrodes having apertures to permit the passage of said plurality of electrodes having apertures being provided for each of the paths of said plurality of electron beams; and the center axes of outer apertures of at least one of the electrodes on the side of said phosphor screen being deviated inwardly from the corresponding axes of said initial paths.

15. An electron gun for a color picture tube according to claim 14, wherein said apertures of said pair of electrodes have shielding cylinders surrounding the apertures, outer ones of said shielding cylinders being asymmetrical relative to the center axes thereof.

* * * * *

US004833365C1

(12) REEXAMINATION CERTIFICATE (4296th)

United States Patent

Shirai et al.

(10) Number: US 4,833,365 C1

(45) Certificate Issued: Mar. 27, 2001

(54) ELECTRON GUN STRUCTURE FOR CONVERGING ELECTRON BEAMS

(75) Inventors: Shoji Shirai, Koganei; Hidemasa Komoro, Chousei; Yoshiaki Takahashi, Chiba; Masakazu Fukushima, Nishitama; Kazuo Majima, Mobara, all of (JP)

(73) Assignees: Hitachi, Ltd., Tokyo; Hitachi Device Engineering Co., Ltd., Mobara, both of (JP)

Reexamination Request:
No. 90/005,383, Jun. 4, 1999

Reexamination Certificate for:

| | |
|---|---|
| Patent No.: | **4,833,365** |
| Issued: | **May 23, 1989** |
| Appl. No.: | **07/013,903** |
| Filed: | **Feb. 12, 1987** |

(51) Int. Cl.[7] ..... H01J 29/51; H01J 29/62

(52) U.S. Cl. ..... 313/414; 313/412

(58) Field of Search ..... 313/409, 412, 313/414, 425

(56) References Cited

U.S. PATENT DOCUMENTS

| | | | |
|---|---|---|---|
| 4,499,402 | 2/1985 | van der Heijden | 313/414 |
| 4,890,032 | 12/1989 | Bijima et al. | 313/412 |

FOREIGN PATENT DOCUMENTS

| | | | |
|---|---|---|---|
| 60-218744 | 11/1985 | (JP) | H01J/29/50 |

*Primary Examiner*—Michael Day

(57) ABSTRACT

An electron gun for a color picture tube consists of a triode that generates a plurality of electron beams and a main lens which focuses and converges the electron beams. The main lens can be divided into two types, i.e., a pair of bi-potential focusing electron lenses and a combination of the bi-potential focusing electron lens and a uni-potential focusing electron lens. The electrodes constituting the main lens have apertures for permitting the transmission of a plurality of electron beams. The center axes of apertures are deviated toward the center axis of the embodiment of electron gun away from the axes of initial paths of the electron beams emitted from the triode.

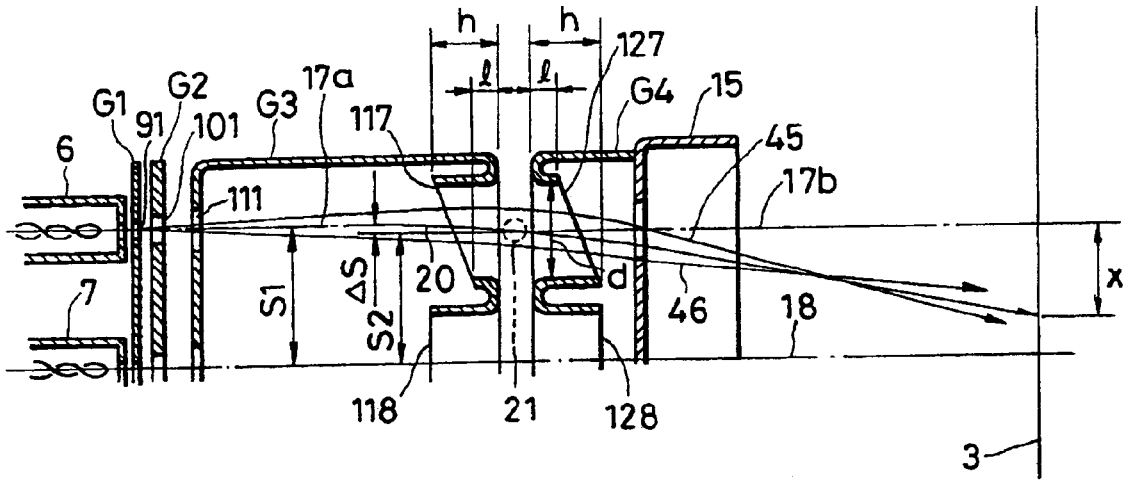

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 8, 14 and 15 are determined to be patentable as amended.

Claims 4–7 and 9–13, dependent on an amended claim are determined to be patentable.

New claims 16–33 are added and determined to be patentable.

1. An electron gun for a color picture tube comprising:

first electrode means which generates a plurality of electron beams that are oriented along the axes of initial paths which are in parallel with each other; and second electrode means which focuses said plurality of electron beams onto a phosphor screen, which converges said plurality of electron beams onto predetermined positions on said phosphor screen, and which constitutes a main lens for each of the paths of said plurality of electron beams;

said second electrode means being comprised of at least a pair of electrodes *having directly opposing surfaces* that are provided maintaining a distance along the axes of said initial paths;

the *directly* opposing surfaces of said *at least a* pair of electrodes *of said second electrode means* having apertures to permit the passage of said plurality of electron beams, the apertures being provided for each of the paths of said plurality of electron beams; [and]

the center axes of outer apertures of at least [the] *an* electrode on the side of said phosphor screen [between] *of* said *at least a* pair of electrodes *of said second electrode means having the directly opposing surfaces* being deviated toward the center axis of the electron gun away from the axes of said initial paths; *and*

*the directly opposing surfaces of at least one pair of said at least a pair of electrodes of said second electrode means having apertures to permit the passage of said plurality of electron beams, the apertures being provided for each of the paths of said plurality of electron beams, the center axes of outer apertures of the electrode on the side of said phosphor screen of said at least one pair of said at least a pair of electrodes having the directly opposing surfaces being deviated toward the center axis of the electron gun as compared with the corresponding center axes of outer apertures of the other electrode of said at least one pair of said at least a pair of electrodes having the directly opposing surfaces.*

2. An electron gun for a color picture tube according to claim 1, wherein at least one electrode [between] *of said at least one pair of* said *at least a* pair of electrodes has shielding plates to surround the center axis of the apertures of said *at least one* electrode, the center axis of said outer apertures not being common to the center axis of said electron gun, and said shielding plates for said outer apertures being asymmetrical relative to the center axis thereof, and the center axes of the outer apertures of *said at least one pair of* said *at least a* pair of electrodes are common relative to each other, and are deviated toward the center axis of said electron gun away from the axes of said initial paths.

3. An electron gun for a color picture tube according to claim 2, wherein said shielding plates are provided in the *directly* opposing directions with the opposing surfaces of said pair of electrodes as a center, and are constituted by cylinders that are provided in concentric with the center axis of said outer apertures, and end surfaces of said cylinders are tilted so that the electron beams are deflected toward the center axis of said electron gun relative to the center axis of said openings.

8. An electron gun for a color picture tube according to claim 7, wherein the center axis of apertures of said third, fourth and sixth electrodes and the center axis of apertures of said fifth electrode on the side of said sixth electrode, are common to the axis of said initial path, provision is made of cylindrical shielding plates that are directed in the opposite directions with the *directly* opposing surfaces of said fifth and sixth electrodes as a center to surround the center axis of outer apertures of said fifth and sixth electrodes that is not common to the center axis of said electron gun, said cylindrical shielding plates being in concentric with the center axis of said outer apertures of said fifth and sixth electrodes, and the ends of the cylinders are so tilted that said electron beam is deflected toward the center axis of said electron gun relative to the center axis of the apertures of said cylinders.

14. An electron gun for a color picture tube comprising:

first electrode means which generates a plurality of electron beams that are oriented along the axes of initial paths which are in parallel with each other; and second electrode means which focuses said plurality of electron beams onto a phosphor screen, which converges said plurality of electron beams onto predetermined positions on said phosphor screen, and which constitutes a main lens for each of the paths of said plurality of electron beams;

said second electrode means including at least a pair of electrodes *having directly opposing surfaces* that are provided maintaining a distance along the axes of said initial paths;

the *directly* opposing surfaces of said *at least a* pair of electrodes having apertures to permit the passage of said plurality of [electrodes having] *electron beams, the* apertures being provided for each of the paths of said plurality of electron beams; [and]

the center axes of outer apertures of at least one of the electrodes *of said at least a pair of electrodes having the directly opposing surfaces* on the side of said phosphor screen being deviated inwardly from the corresponding axes of said initial paths; *and*

*the directly opposing surfaces of at least one pair of said at least a pair of electrodes of said second electrode means having apertures to permit the passage of said plurality of electron beams, the apertures being provided for each of the paths of said plurality of electron beams, the center axes of outer apertures of the electrode on the side of said phosphor screen of said at least one pair of said at least a pair of electrodes having the directly opposing surfaces being deviated toward the center axis of the electron gun as compared*

*with the corresponding center axes of outer apertures of the other electrode of said at least one pair of said at least a pair of electrodes having the directly opposing surfaces.*

15. An electron gun for a color picture tube according to claim 14, wherein said apertures of *said at least one pair of* said *at least a* pair of electrodes have shielding cylinders surrounding the apertures, outer ones of said shielding cylinders being asymmetrical relative to the center axes thereof.

*16. An electron gun for a color picture tube according to claim 1, wherein said second electrode means comprise a third electrode, a fourth electrode, a fifth electrode, and a sixth electrode that are arranged from said first electrode means toward said phosphor screen, said third electrode and said fourth electrode forming said at least one pair of electrodes having the directly opposing surfaces, the center axes of outer apertures of said fourth electrode which opposes surfaces of said third electrode are deviated toward the center axes of said electron gun as compared with the center axis of outer apertures of said third electrode which opposes surfaces of said fourth electrode.*

*17. An electron gun for a color picture tube according to claim 16, wherein a high voltage is applied to said sixth electrode, a medium voltage is applied to said third and fifth electrodes, and a low voltage is applied to said fourth electrode and to an electrode of said first electrode means.*

*18. An electron gun for a color picture tube according to claim 16 or 17, said fourth electrode is a plate electrode.*

*19. An electron gun for a color picture tube according to claim 16 or 17, wherein the center axes of outer apertures of opposing surfaces of said fifth electrode and said sixth electrode are common relative to each other.*

*20. An electron gun for a color picture tube according to claim 19, wherein the center axes of outer apertures of opposing surfaces of said fifth electrode and said sixth electrode are common to the axes of said initial paths.*

*21. An electron gun for a color picture tube according to claim 19, wherein the center axes of outer apertures of opposing surfaces of said fifth electrode and said sixth electrode are deviated toward the center axis of said electron gun away from the axes of said initial paths.*

*22. An electron gun for a color picture tube according to claim 16 or 17, wherein said fifth electrode and sixth electrode oppose each other, each of an opposing end of said fifth electrode and sixth electrode having a common single opening for said plurality of electron beams, and each of said fifth and sixth electrodes having apertures for each of said plurality of electron beams recessed from said opposing end.*

*23. An electron gun for a color picture tube according to claim 22, wherein the center axes of the outer apertures of said recessed apertures of said fifth electrode and said sixth electrode are common relative to each other.*

*24. An electron gun for a color picture tube according to claim 23, wherein the center axes of the outer apertures of said recessed apertures of said fifth electrode and said sixth electrode are deviated toward the center axis of said electron gun away from the axes of said initial paths.*

*25. An electron gun for a color picture tube according to claim 1, wherein said second electrode means comprises a plurality of electrodes arranged in order from said first electrode means towards said phosphor screen, the directly opposing surfaces and apertures of respective ones of said plurality of electrodes being opposed to the surfaces and apertures of an adjacent electrode so that the adjacent electrodes form respective electrode pairs, the center axes of outer apertures of the electrode on the side of said phosphor screen in an electrode pair other than the last electrode pair located most closely to said phosphor screen beng deviated toward the center axis of said electron gun as compared with the center axes of the outer apertures of said adjacent electrode located on the side of said first electrode means of said electrode pair.*

*26. An electron gun for a color picture tube according to claim 1, wherein said at least a pair of electrodes and said at least one pair of electrodes are the same pair of electrodes of said second electrode means.*

*27. An electron gun for a color picture tube according to claim 1, wherein said at least a pair of electrodes and said at least one pair of electrodes include different pairs of electrodes of said second electrode means.*

*28. An electron gun for a color picture tube according to claim 14, wherein said second electrode means comprises a third electrode, a fourth electrode, a fifth electrode, and a sixth electrode that are arranged from said first electrode means toward said phosphor screen, said third electrode and said fourth electrode directly oppose to each other, the center axes of outer apertures of said fourth electrode which opposes surfaces of said third electrode are deviated toward the center axis of said electron gun as compared with the center axes of outer apertures of said third electrode which directly opposes surfaces of said fourth electrode.*

*29. An electron gun for a color picture tube according to claim 28, wherein a high voltage is applied to said sixth electrode, a medium voltage is applied to said third and fifth electrodes, and a low voltage is applied to said fourth electrode and to an electrode of said electrode means.*

*30. An electron gun for a color picture tube according to claim 28 or 29, wherein said fourth electrode is a plate electrode.*

*31. An electron gun for a color picture tube according to claim 14, wherein said second electrode means comprises a plurality of electrodes arranged in order from said first electrode means towards said phosphor screen, the directly opposing surfaces and apertures of respective ones of said plurality of electrodes being opposed to the surfaces and apertures of an adjacent electrode so that the adjacent electrodes form respective electrode pairs, the center axes of outer apertures of the electrode on the side of said phosphor screen in an electrode pair other than the last electrode pair located most closely to said phosphor screen being deviated toward the center axis of said electron gun as compared with the center axes of the outer apertures of said adjacent electrode located on the side of said first electrode means of said electrode pair.*

*32. An electron gun for a color picture tube according to claim 14, wherein said at least a pair of electrodes and said at least one pair of electrodes are the same pair of electrodes of said second electrode means.*

*33. An electron gun for a color picture tube according to claim 14, wherein said at least a pair of electrodes and said at least one pair of electrodes include different pairs of electrodes of said second electrode means.*

* * * * *